United States Patent [19]

Sanada et al.

[11] Patent Number: 4,898,131

[45] Date of Patent: Feb. 6, 1990

[54] VALVE ACTUATING MECHANISM FOR INTERNAL COMBUSTION MECHANISM

[75] Inventors: Makoto Sanada; Hiroshi Yamashita; Shinichiro Izawa; Toshikazu Hamamoto, all of Wako, Japan

[73] Assignee: Honda Giken Kogyo K.K., Tokyo, Japan

[21] Appl. No.: 319,113

[22] Filed: Mar. 3, 1989

[30] Foreign Application Priority Data

Mar. 18, 1988 [JP] Japan ..... 63-65319
Mar. 18, 1988 [JP] Japan ..... 63-65325

[51] Int. Cl.[4] ..... F01L 1/08; F01L 1/18
[52] U.S. Cl. ..... 123/90.44; 123/90.6
[58] Field of Search ..... 123/90.33, 90.39, 90.41, 123/90.44, 90.47, 90.6

[56] References Cited

U.S. PATENT DOCUMENTS 4,365,785 12/1982 Miller ..... 123/90.39
4,672,927 6/1987 Uchida ..... 123/90.39
4,793,297 12/1988 Fujii et al. ..... 123/90.44

FOREIGN PATENT DOCUMENTS 2350664 4/1974 Fed. Rep. of Germany ... 123/90.39
0075304 4/1988 Japan ..... 123/90.39
0173808 7/1988 Japan ..... 123/90.39

*Primary Examiner*—Willis R. Wolfe
*Assistant Examiner*—Weilun Lo
*Attorney, Agent, or Firm*—Arthur L. Lessler

[57] ABSTRACT

A valve actuating mechanism for an internal combustion engine in which a rotatable cam has its camming surface disposed to slide on a cam slipper surface of a rocker arm to thereby open and close an intake valve (or exhaust valve) of the engine by rocking motion of the rocker arm. The dimensions, shapes, and relative positions of the rotatable cam and the rocker arm are so designed as to satisfy a condition of $V_C+V_F>0$, where $V_C$ represents the velocity of movement of a contact point on the camming surface at which the camming surface slides on the cam slipper surface, and $V_F$ the velocity of movement of the contact point on the cam slipper surface at which the cam slipper surface slides on the camming surface.

3 Claims, 6 Drawing Sheets

VELOCITY OF LUBRICATING OIL AT CONTACT POINT BETWEEN CAMMING SURFACE AND CAM SLIPPER SURFACE

VALVE ACTUATING MECHANISM FOR INTERNAL COMBUSTION MECHANISM

BACKGROUND OF THE INVENTION

The present invention relates to a valve actuating mechanism for opening and closing an intake or exhaust valve of an internal combustion engine installed on a vehicle.

Conventionally, a valve actuating mechanism for internal combustion engines as shown in FIG. 1 is known in which a rotating cam 1 has its camming surface 2 disposed to slide on a cam slipper surface 4 of a rocker arm 3 to thereby open and close an intake valve 5 (or exhaust valve 6) by rocking motion of the rocker arm 3.

This type of valve actuating mechanism is required to have so high wear resistance that it is not adversely affected by lubricating conditions which may vary according to the type of lubricating oil used and running conditions of the vehicle, as well as to be light in weight to contribute to grading up the performance of the engine.

However, the conventional valve actuating mechanism has the disadvantage that the camming surface 2 and the cam slipper surface 4 are liable to wear, which makes it impossible to meet the above requirements.

Analysis of the cause of the wear has revealed that, in almost all cases, the wear is caused by scuffing due to breakage of the oil film. Breakage of the oil film can cause scuffing and sometimes even seizure even if the pressure or load acting upon the camming surface 2 and/or the cam slipper surface 4 is reduced, which, therefore, cannot completely solve the problem.

SUMMARY OF THE INVENTION

It is an object of the invention to provide a valve actuating mechanism for internal combustion engines which is free from breakage of oil film between the camming surface and the cam slipper surface, and hence has increased wear resistance.

It is a further object of the invention to provide a valve actuating mechanism for internal combustion engines which is reduced in weight.

In order to attain the above objects, the invention provides a valve actuating mechanism for an internal combustion engine having at least one intake valve and at least one exhaust valve, including a rotatable cam having a camming surface, and a rocker arm having a cam slipper surface disposed in slidable contact with said camming surface, wherein said intake valve or said exhaust valve is opened and closed by rocking motion of said rocker arm caused by rotation of said rotatable cam.

The valve actuating mechanism according to the invention is characterized by the improvement wherein said rotatable cam and said rocker arm have dimensions, shapes, and relative positions so designed as to safisfy a condition of $V_C+V_F>0$, where $V_C$ represents velocity of movement of a contact point on said camming surface of said rotatable cam at which said camming surface slides on said cam slipper surface, and $V_F$ represents velocity of movement of the contact point on said cam slipper surface at which said cam slipper surface slides on said camming surface.

According to a first embodiment of the invention, the condition of $V_C+V_F>0$ is satisfied by setting r and a such that $a/r \leqq 2.1$ is satisfied, where r represents radius of a base circle of said camming surface, and a represents radius of curvature of said cam slipper surface.

According to a second embodiment of the invention, said rocker arm has a pivot having a fulcrum point about which said rocker arm rocks, and a stem slipper surface disposed in slidable contact with said intake valve or said exhaust valve, and the condition of $V_C+V_F>0$ is satisfied by the following expression:

$$\left(\frac{2}{r+a}-\frac{1}{a}\right)\sqrt{b^2(1+\dot{\Gamma})^2+c^2-2bc(1+\dot{\Gamma})\cos(\dot{\Gamma}+\lambda)}<1+\dot{\Gamma}$$

where r: radius of a base circle of said camming surface;

a: radius of curvature of said cam slipper surface of said rocker arm;

b: distance between the fulcrum point of said pivot and center of curvature of said cam slipper surface;

c: distance between the fulcrum point of said pivot and axis of said cam shaft $\dot{\Gamma}$: angle formed by a straight line passing through the fulcrum point of said pivot and center of curvature of said stem slipper surface, and a straight line passing through the fulcrum point of said pivot and the axis of said cam shaft; and $\lambda$: angle formed by a straight line passing through the fulcrum point of said pivot and the center of curvature of said stem slipper surface, and a straight line passing through the fulcrum point of said pivot and the center of curvature of said cam slipper surface.

The above and other objects, features, and advantages of the invention will be more apparent from the ensuing detailed description taken in conjunction with the accompanying drawings.

DETAILED DESCRIPTION

Figure 1:
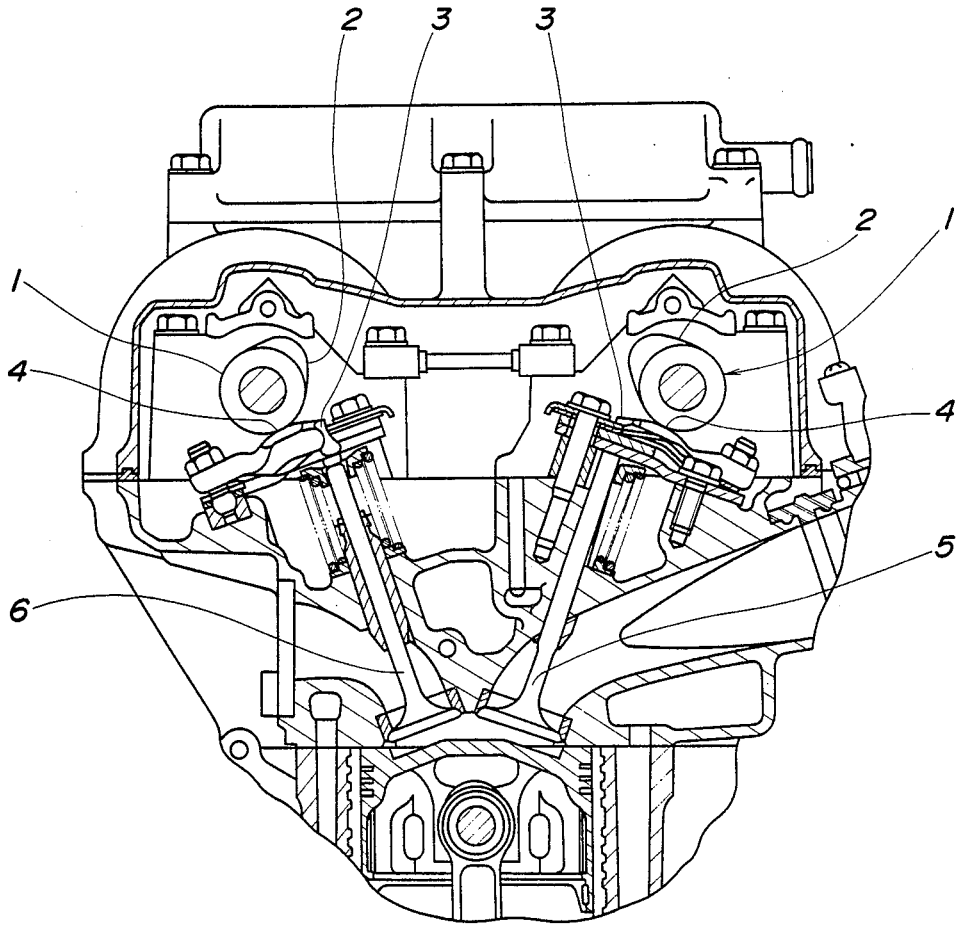
FIG. 1 PRIOR ART
FIG. 1 is a sectional view of a conventional valve actuating mechanism.
Figure 2:
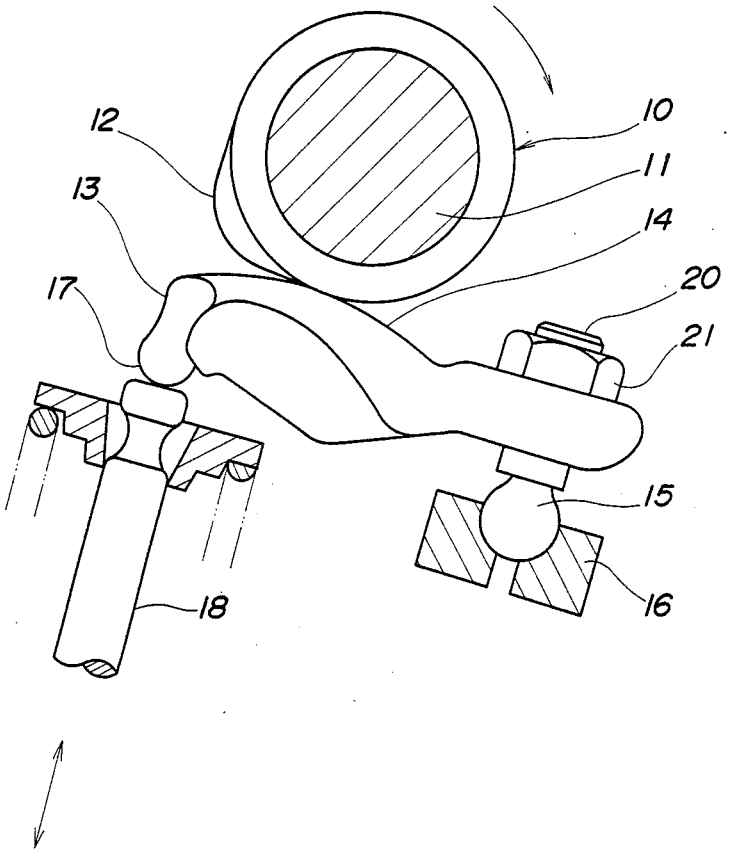
FIG. 2 is a sectional view of essential parts of a valve actuating mechanism according to a first embodiment of the present invention.

The invention will be described in detail below with reference to FIGS. 2 to 9 of the drawings. FIG. 2 shows essential parts of a valve actuating mechanism for an internal combustion engine according to the invention. In the figure, reference numeral 10 designates a cam which is rotatable in the direction indicated by the arrow. The cam 10 is integrally formed on a cam shaft 11. The cam 10 has its camming surface 12 disposed in slidable contact with a cam slipper surface 14 of a rocker arm 13. The rocker arm 13 has a spherical pivot 15 downwardly pendent from an end thereof and fixed to the end by a nut 20 and a bolt 21. The pivot 15 is pivotally fitted in a bearing 16 to thereby support the rocker arm 13 for rocking motion about the pivot 15 and bearing 16 as a fulcrum. The rocker arm 13 also has a stem slipper 17 integrally formed at another end thereof and extending downward therefrom in slidable contact with an upper end face of a stem 18 of an intake valve or an exhaust valve. With rotation of the cam 10, the rocker arm 13 is caused to make a rocking motion, which in turn causes the stem 18 to reciprocate in the directions indicated by the arrows, whereby the intake or exhaust valve is opened and closed. The basic construction of the valve actuating mechanism described above is similar to that of the prior art.

Figure 3:
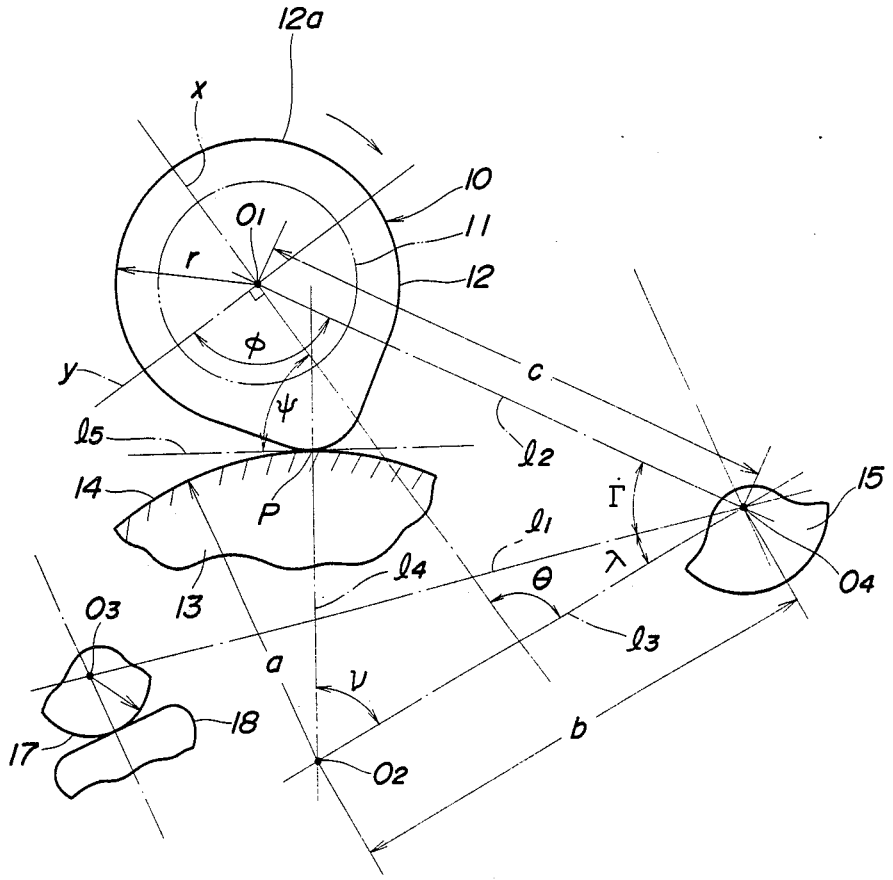
FIG. 3 is a diagram showing the dimensional relationships between the essential parts of the valve actuating mechanism shown in FIG. 2.

Features of the invention which are novel and different from the prior art will be described below. FIG. 3 diagrammatically shows the essential parts of the valve actuating mechanism with numerals and symbols useful for explaining the principle of the invention. In the figure, r represents the radius of the base circle 12*a* of the camming surface 12, $0_1$ the axis of the cam shaft 11, $0_2$ the center of curvature of the cam slipper surface 14 of the rocker arm 13, $0_3$ the center of curvature of the stem slipper surface 17 of the rocker arm 13, $0_4$ the fulcrum point of the pivot 15, P a contact point between the camming surface 12 and the cam slipper surface 14, a the radius of curvature of the cam slipper surface 14 of the rocker arm 13, b the distance between the fulcrum point $0_4$ of the pivot 15 and the center $0_2$ of curvature of the cam slipper surface 14 of the rocker arm 13, c the distance between the fulcrum point $0_4$ of the pivot 15 and the axis $0_1$ of the cam shaft 11, $1_1$ a straight line passing through the fulcrum point $0_4$ of the pivot 15 and the center $0_3$ of curvature of the stem slipper surface 17 of the rocker arm 13, $1_2$ a straight line passing through the fulcrum point $0_4$ of the pivot 15 and the axis $0_1$ of the cam shaft 11, $1_3$ a straight line passing through the fulcrum point $0_4$ of the pivot 15 and the center $0_2$ of curvature of the cam slipper surface 14 of the rocker arm 13, $1_4$ a straight line passing through the center $0_2$ of curvature of the cam slipper surface 14 of the rocker arm 13 and the contact point P between the camming surface 12 and the cam slipper surface 14, $1_5$ a common straight line tangential to the camming surface 12 and the cam slipper surface 14 at the contact point P, y a straight line passing through the axis $0_1$ of the cam shaft 11 and intersecting with the straight line $1_2$ at an angle $\phi$ thereto, x a straight line passing through the axis $0_1$ of the cam shaft 11 and intersecting with the straight line y at a right angle thereto, $\Gamma$ an angle formed by the straight lines $1_1$ and $1_2$, $\lambda$ an angle formed by the straight lines $1_1$ and $1_3$, $\nu$ an angle formed by the straight lines $1_3$ and $1_4$, $\psi$ an angle formed by the common tangent $1_5$ and the straight line x, and $\theta$ an angle formed by the straight lines $1_3$ and x.

According to the invention, the following condition is always satisfied throughout the entire angles of the cam 10, i.e. irrespective of the angles assumed by the cam 10:

$$V_C+V_F>0 \quad (1)$$

where $V_C$ represents the velocity of movement of a contact point on the camming surface 12 at which the camming surface 12 slides on the cam slipper surface 14, and $V_F$ represents the velocity of movement of the contact point on the cam slipper surface 14 of the rocker arm 13 at which the cam slipper surface 14 slides on the camming surface 12.

If the valve actuating mechanism is arranged and constructed such that the above condition is satisfied, the velocity at which lubricating oil passes between the camming surface 12 and the cam slipper surface 14 does not become zero, so that breakage of oil film does not occur.

The breakage of oil film occurs when the velocity at which the lubricating oil passes between the camming surface 12 and the cam slipper surface 14 is zero.

Figure 4:
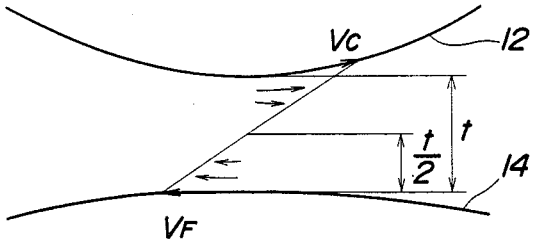
FIG. 4 is a diagram showing the velocity at which lubricating oil passes between the camming surface and the cam slipper surface.

FIG. 4 shows velocities at which the lubricating oil passes between the camming surface and the cam slipper surface. In the figure, supposing that t represents an apparent clearance between the camming surface 12 and the cam slipper surface 14, the breakage of oil film occurs when the velocity component of the lubricating oil at a point of t/2 equals 0, i.e. the speed at which the lubricating oil passes is 0. If viewed in terms of the velocity of movement of the contact point P on the camming surface 12 at which the camming surface 12 contacts the cam slipper surface 14, the breakage of oil film occurs when $V_C=-V_F$.

A first embodiment of the invention which satisfies the above expression (1) will be described below.

According to the first embodiment, the radius r of the base circle 12*a* and the radius a of the curvature of the cam slipper surface 14 are set at such values as to satisfy the following expression (2):

$$a/r \leqq 2.1 \quad (2)$$

Figure 5:
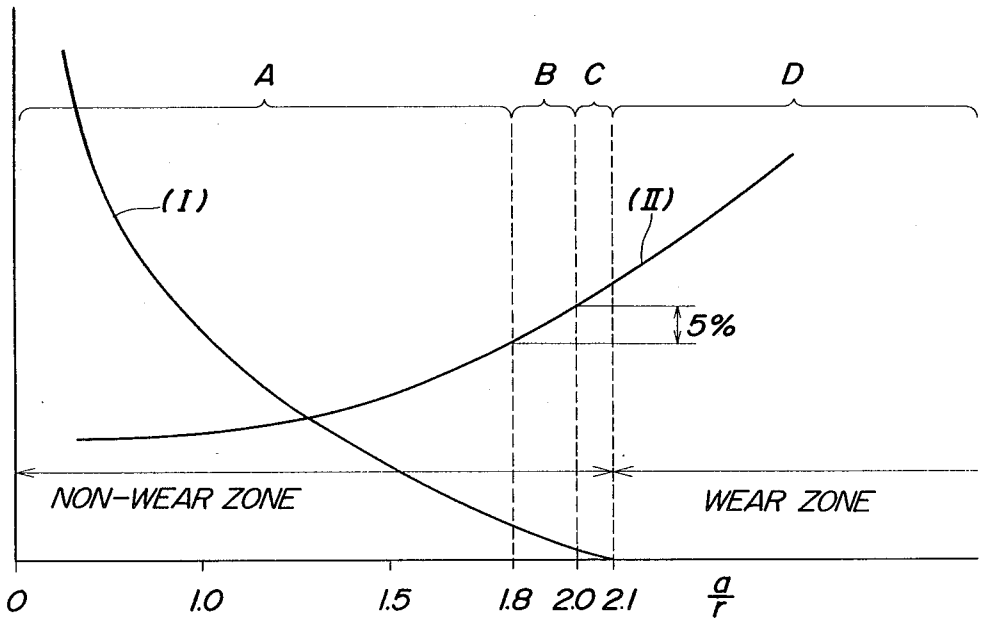
FIG. 5 is a graph showing the relationships between the ratio of the radius of curvature of the cam slipper surface to the radius of the base circle of the camming surface, the velocity at which lubricating oil passes at a contact point between the camming surface and the cam slipper surface, and the weight of the rocker arm.

FIG. 5 shows the relationships between the ratio a/r of the radius a of curvature of the slipper surface 14 to the radius r of the base circle of the camming surface 12, the velocity at which the lubricating oil passes at the contact point between the camming surface 12 and the cam slipper surface 14, and the weight of the rocker arm 13. In the figure, a curve (I) indicates the velocity $V_C+V_F$ of the lubricating oil, and a curve (II) indicates the weight of the rocker arm 13. The curve (II) has been obtained by varying the radius r of the base circle 18 while the radius a of curvature of the cam slipper surface 14 is kept at a constant value.

As is clear from FIG. 5, the velocity $V_C+V_F$ of the lubricating oil passing through the contact point between the camming surface 12 and the cam slipper surface 14 becomes zero when a/r exceeds 2.1.

Further, a range A of $0<a/r\leqq 1.8$ indicates an optimum zone in which the weight of the rocker arm 13 can be reduced by an amount of 5% or more as compared with that of the conventional rocker arm, and the velocity of the lubricating oil becomes so high that the formability of lubricating oil film between the camming surface 12 and the cam slipper surface 14 is improved to a large degree.

A range B of $1.8 < a/r \leqq 2.0$ indicates a zone in which the weight of the rocker arm 13 can be reduced by an amount of less than 5%, and at the same time the velocity of the lubricating oil is a little increased so that the formability of lubricating oil film between the camming surface 12 and the cam slipper surface 14 is improved to some degree.

A range C of $2.0 < a/r \leqq 2.1$ indicates a critical zone in which the velocity of the lubricating oil is not equal to 0, i.e., no breakage of oil film occurs, but above which the lubricating oil velocity is equal to 0 to cause breakage of oil film.

A range D of $a/r > 2.1$ indicates a zone in which, as described above, the lubricating oil velocity is equal to 0 to thereby cause breakage of oil film.

Figure 6:
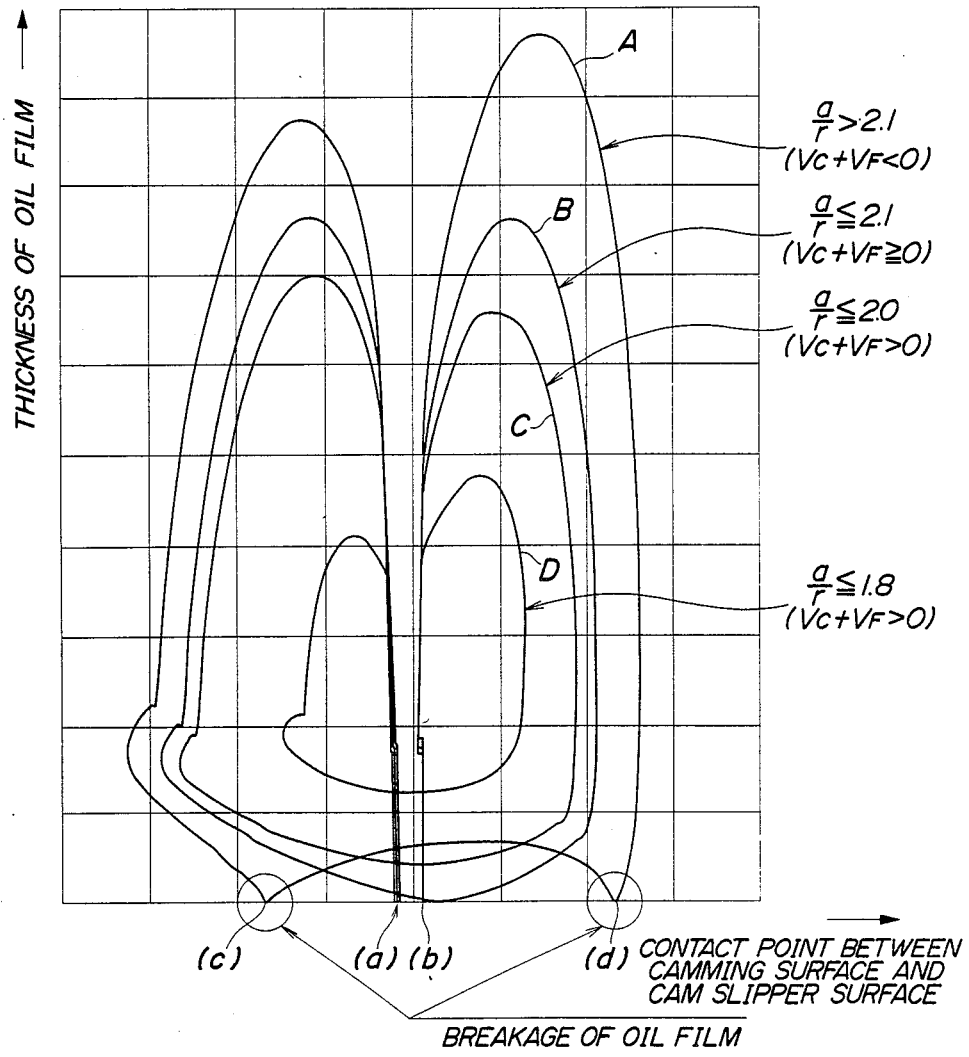
FIG. 6 is a graph showing the relationship between the thickness of oil film between the camming surface and the cam slipper surface, and the contact point between the camming surface and the cam slipper surface.

In the case of $a/r > 2.1$, the oil film is broken at two points on the cam slipper surface 14, as shown in FIG. 6.

FIG. 6 shows the relationship between the thickness of oil film between the camming surface 12 and the cam slipper surface 14, and the contact point between the camming surface 12 and the cam slipper surface 14. In the figure, (a) indicates a point at which the high of the camming surface 12 starts to slide on the cam slipper surface 14, and (b) indicates a point at which the high of the camming surface 12 finishes sliding on the cam slipper surface 14.

In the figure, a curve A is obtained in the case of $a/r > 2.1$, where the thickness of oil film becomes 0, i.e. the oil film is broken at two points (c) and (d).

Further, curves B, C, and D are obtained in the cases of $a/r \leqq 2.1$, $a/r \leqq 2.0$, and $a/r \leqq 1.8$, respectively. In all these cases, the thickness of the oil film does not become 0, and therefore the oil film is not broken.

Therefore, the valve actuating mechanism according to the present invention is free from breakage of the oil film between the camming surface 12 and the cam slipper surface 14, and therefore has greatly improved wear resistance. Further, it is possible to reduce the weight of the rocker arm 13 since the length of the cam slipper surface 14 thereof can be reduced by setting the values of a/r to 2.0 or less.

Next, a second embodiment of the invention which satisfies the above equation (1) will be described below.

In FIG. 3, the moving velocity $V_C$ of the contact point on the camming surface 12 of the cam 10 at which the camming surface 12 slides on the cam slipper surface 14 of the rocker arm 13, and the moving velocity $V_F$ of the contact point on the cam slipper surface 14 at which the cam slipper surface 14 slides on the cam 10 can be expressed by the following expressions:

$$V_C = r\frac{d\phi}{d\phi} \tag{3}$$

$$V_F = -a\frac{dv}{d\phi} \tag{4}$$

From the above expressions (3) and (4), and the aforegiven expression (1), the following inequality (5) holds:

$$r\frac{d\phi}{d\phi} + \left(-a\frac{dv}{d\phi}\right) > 0 \tag{5}$$

Here, $$\frac{d\phi}{d\phi} = \frac{\sqrt{b^2(1+\dot{\Gamma})^2 + c^2 - 2bc(1+\dot{\Gamma})\cos(\dot{\Gamma}+\lambda)}}{a+r} \tag{6}$$

$$\frac{dv}{d\phi} = \frac{d\phi}{d\phi} - \dot{\Gamma} - 1 \tag{7}$$

Therefore, the following expression can be obtained:

$$V_C + V_F = \frac{r-a}{r+a}\sqrt{b^2(1+\dot{\Gamma})^2 + c^2 - 2bc(1+\dot{\Gamma})\cos(\dot{\Gamma}+\lambda)} + a(1+\dot{\Gamma}) > 0 \tag{8}$$

The above expression (8) can be transformed as follows:

$$\left(\frac{2}{r+a} - \frac{1}{a}\right)\sqrt{b^2(1+\dot{\Gamma})^2 + c^2 - 2bc(1+\dot{\Gamma})\cos(\dot{\Gamma}+\lambda)} < 1 + \dot{\Gamma} \tag{9}$$

In this embodiment, the sum of $V_C$ and $V_F$ satisfies the above expression (9) throughout the entire cam angle range.

If the valve actuating mechanism is designed such that the above expression (9) is satisfied, the velocity at which the lubricating oil passes between the camming surface 12 and the cam slipper surface 14 is prevented from becoming zero with more certainty, which results in more positive prevention of breakage of the oil film. According to this embodiment, the excellent effects described with reference to FIGS. 4 and 6 can be obtained with more certainty.

Figure 7:
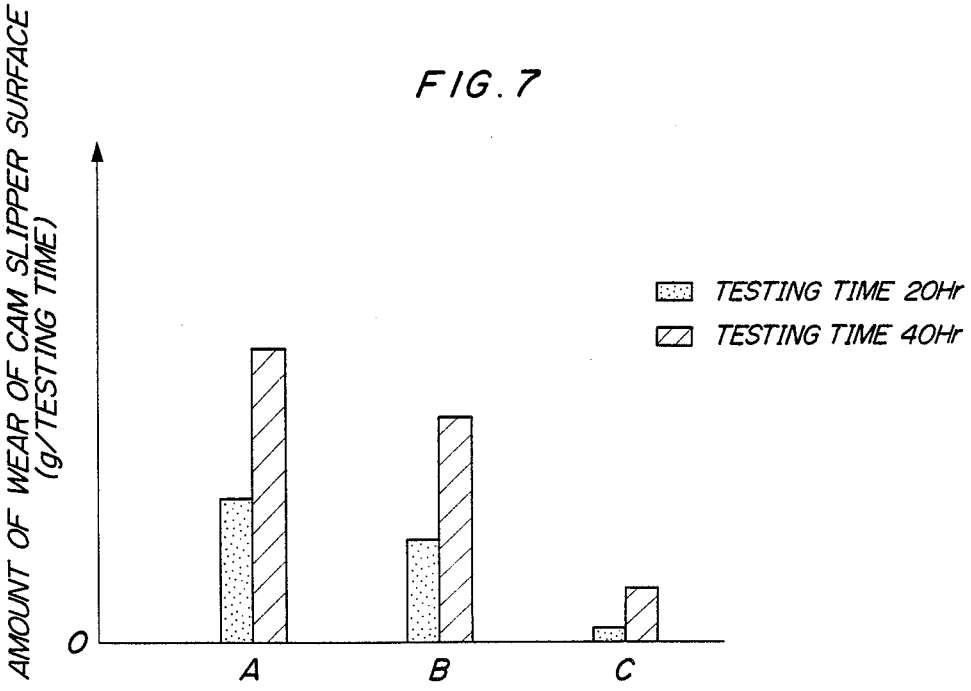
FIG. 7 is a graph showing results of endurance tests conducted on the rocker arm of the conventional valve actuating mechanism and the rocker arm of the valve actuating mechanism according to the invention.

FIG. 7 is a graph showing results of endurance tests carried out for two testing time periods of 20 hr and 40 hr on a valve actuating mechanism designed to satisfy the above expression (9) according to the invention, and two other valve actuating mechanisms which are different in the value of $V_C+V_F$ from the former valve actuating mechanism. In the figure, A indicates results of one of the other valve actuating mechanisms which satisfies $V_C+V_F<0$, B results of the other thereof which satisfies $V_C+V_F<0$, and C results of the present invention wherein $V_C+V_F>0$.

With respect to each of A, B, and C, the dotted bar represents the result of a test carried out for a time period of 20 hr, and the hatched bar one carried out for a time period of 40 hr.

As is clear from the figure, C indicating the results of the present invention shows amounts of wear of the cam slipper surface 14 much smaller than those shown by A and B indicating the results of the prior art. This means that the valve actuating mechanism according to the invention has the most excellent lubricity between the cam 10 and the rocker arm 13. Further, the prior art cases of A and B undergo scuffing wear over the entire cam slipper surface 14, whereas the case C according to the present invention hardly undergoes scuffing wear over the cam slipper surface 14.

What is claimed is:

1. In a valve actuating mechanism for an internal combustion engine having at least one intake valve and at least one exhaust valve, including a rotatable cam having a camming surface, and a rocker arm having a cam slipper surface disposed in slidable contact with said camming surface, wherein said intake valve or said exhaust valve is opened and closed by rocking motion of said rocker arm caused by rotation of said rotatable cam, the improvement wherein said rotatable cam and said rocker arm have dimensions, shapes, and relative positions so designed as to satisfy a condition of $V_C+V_F>0$ irrespective of the angles assumed by said rotatable cam, where $V_C$ represents velocity of movement of a contact point on said camming surface of said rotatable cam at which said camming surface slides on said cam slipper surface, and $V_F$ represents velocity of movement of the contact point on said cam slipper surface at which said cam slipper surface slides on said camming surface.

2. A valve actuating mechanism as claimed in claim 1, wherein the condition of $V_C+V_F>0$ is satisfied by setting r and a such that $a/r \leqq 2.1$ is satisfied, where r represents radius of a base circle of said camming surface, and a represents radius of curvature of said cam slipper surface.

3. A valve actuating mechanism as claimed in claim 1, wherein said rocker arm has a pivot having a fulcrum point about which said rocker arm rocks, and a stem slipper surface disposed in slidable contact with said intake valve or said exhaust valve, and the condition of $V_C+V_F>0$ is satisfied by the following expression:

$$\left(\frac{2}{r+a}-\frac{1}{a}\right)\sqrt{b^2(1+\dot{\Gamma})^2+c^2-2bc\,(1+\dot{\Gamma})\cos(\dot{\Gamma}+\lambda)} < 1+\dot{\Gamma}$$

where r: radius of a base circle of said camming surface;

a: radius of curvature of said cam slipper surface of said rocker arm;

b: distance between the fulcrum point of said pivot and center of curvature of said cam slipper surface;

c: distance between the fulcrum point of said pivot and axis of said cam shaft $\dot{\Gamma}$: angle formed by a straight line passing through the fulcrum point of said pivot and center of curvature of said stem slipper surface, and a straight line passing through the fulcrum point of said pivot and the axis of said cam shaft; and $\lambda$: angle formed by a straight line passing through the fulcrum point of said pivot and the center of curvature of said stem slipper surface, and a straight line passing through the fulcrum point of said pivot and the center of curvature of said cam slipper surface.

* * * * *